US009591703B2

(12) United States Patent
Blount

(10) Patent No.: US 9,591,703 B2
(45) Date of Patent: Mar. 7, 2017

(54) LED SYSTEM WITH TWO WIRE CONTROL CIRCUIT

(71) Applicant: Molex, LLC, Lisle, IL (US)

(72) Inventor: Christopher Blount, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/764,763

(22) PCT Filed: Feb. 3, 2014

(86) PCT No.: PCT/US2014/014374
§ 371 (c)(1),
(2) Date: Jul. 30, 2015

(87) PCT Pub. No.: WO2014/121175
PCT Pub. Date: Aug. 7, 2014

(65) Prior Publication Data

US 2015/0373795 A1 Dec. 24, 2015

Related U.S. Application Data

(60) Provisional application No. 61/759,847, filed on Feb. 1, 2013.

(51) Int. Cl.
*H05B 33/08* (2006.01)
*H05B 37/02* (2006.01)

(52) U.S. Cl.
CPC ..... *H05B 33/0809* (2013.01); *F21K 9/27* (2016.08); *H05B 37/0263* (2013.01); *F21Y 2105/10* (2016.08); *F21Y 2115/10* (2016.08)

(58) Field of Classification Search
CPC ..... H05B 33/0815; H05B 33/0803; H05B 33/0812; H01R 13/7175; H01R 25/142; Y02B 20/342; F21Y 2101/02; F21Y 2103/00; F21Y 2115/10
USPC ..... 315/200 R, 247, 291, 294, 307, 312; 362/648, 362, 221, 391, 227
See application file for complete search history.

(56) References Cited

U.S. PATENT DOCUMENTS 7,688,002 B2 * 3/2010 Ashdown et al. . H05B 33/0818 315/185 S
7,909,499 B2 * 3/2011 Snagel ..... H01R 13/7175 362/221
8,111,001 B2 * 2/2012 Underwood ..... H05B 33/0812 257/84
8,384,304 B2 2/2013 Hung et al.
(Continued)

FOREIGN PATENT DOCUMENTS

EP 1335477 A2 8/2003

*Primary Examiner* — Haissa Philogene
(74) *Attorney, Agent, or Firm* — Jeffrey K. Jacobs

(57) ABSTRACT

An LED module can be powered by two conductors and the LED module includes a constant current driver. The constant current driver is configured to provide a predetermined current so long as the input voltage provided on the two conductors exceeds a predetermined level. The constant current driver powers an LED string supported by the LED module and can adjust the current to the LED string based on an input signal. A conversion circuit converts the input voltage to an input signal and provides that input signal to the constant current driver so that dimming can be provided while only using two conductors to provide power.

11 Claims, 6 Drawing Sheets

(56) References Cited

U.S. PATENT DOCUMENTS

| | | | | |
|---|---|---|---|---|
| 8,491,159 | B2 * | 7/2013 | Recker | H02J 9/02 362/20 |
| 8,567,992 | B2 | 10/2013 | Lo et al. | |
| 8,680,774 | B2 | 3/2014 | vanHoof et al. | |
| 8,710,766 | B2 | 4/2014 | Kanamori et al. | |
| 8,975,821 | B2 * | 3/2015 | Gershowitz | H05B 33/0842 315/186 |
| 9,137,859 | B2 * | 9/2015 | Mituyasu | H05B 33/08 |
| 9,271,345 | B2 * | 2/2016 | Welten | H05B 33/083 |
| 2008/0297058 | A1 | 12/2008 | Soos | |
| 2009/0021180 | A1 | 1/2009 | Underwood et al. | |
| 2009/0244925 | A1 | 10/2009 | Snagel et al. | |
| 2012/0280637 | A1 | 11/2012 | Tikkanen et al. | |
| 2014/0265899 | A1 * | 9/2014 | Sadwick | H05B 33/0812 315/200 R |

* cited by examiner

LED SYSTEM WITH TWO WIRE CONTROL CIRCUIT

RELATED APPLICATIONS

This application claims priority to U.S. Provisional Application No. 61/759,847, filed Feb. 1, 2013, which is incorporated herein by reference in its entirety.

FIELD OF THE INVENTION

The present invention relates to field of LED lights, more specifically the field of controlling LED lights in conjunction with constant current drivers.

DESCRIPTION OF RELATED ART

Constant current drivers are known to be useful in powering LED lights. A typical constant current driver can receive a range of input voltages while providing a constant output current. In other words, changing the input voltage used to power the constant current driver does not impact on the light output of a string of LED chips so long as the input voltage exceeds the minimum forward voltage ($V_f$) required to activate the LED string. Consequentially, LED are often used with a driver (typically the driver is what is known as a buck driver if the input voltage exceeds the voltage needed to drive the LEDs at the desired current) that is configured to provide a constant output current so long as the input voltage is within a range of input voltages that exceeds the forward voltage ($V_f$). For example, in an embodiment the constant current driver can receive an input of between $V_f$+2 to $V_f$+15 volts and provides a constant current output with a voltage that exceeds the $V_f$ of the LED string. Many of these constant current drivers also have a dimming capability based on receipt of a signal, which can be an input V that ranges from 1X-10X (where X is the size of the voltage step between different signal levels) that can allow the amount of current to be reduced from 100 percent to 10 percent in 10 percent increments. While it is simple to provide the dimming voltage signal in many fixtures, certain individuals would appreciate an improved method of providing an input signal to fixtures suitable for use in track lighting applications or other applications where providing the input signal is not as easy.

BRIEF SUMMARY

A LED system includes an LED string of on ore more LEDs powered by a constant current driver. A voltage module is used to provide a first voltage ($V_1$) that is greater than a forward voltage ($V_F$) of the LED string and the first voltage is provided to power the constant current driver. A conversion circuit converts the first voltage $V_1$ to a second voltage ($V_S$) that is, at least in part, based on a percentage of the first voltage. The conversion circuit can include a voltage subtraction circuit to step down the first voltage before converting it to a percentage of the first voltage $V_1$.

In an embodiment, the system can be a fixture that includes a first contact and a second contact that are powered by a voltage module, the voltage module configured to provide a first voltage to the first contact. The contacts can optionally be shaped as a rail. An LED module is mounted on the first and second contacts and includes a constant current driver. The constant current driver is configured to provide a current to an LED string supported by the LED module. The constant current driver includes an input signal and the constant current driver is configured to cause the output current to be reduced based on the voltage provided to the input signal. A conversion circuit is provided to convert the first voltage to a signal voltage and provide the signal voltage to the input signal. In an embodiment, the conversion causes the signal voltage to be a percentage of the first voltage so that the two voltages are proportionally related. The signal voltage can vary over the voltage range compatible with the input signal of the constant current driver. In another embodiment, the voltage step-down circuit is configured to provide a signal voltage that can range from about 10X to about 1X in response to the first voltage varying between so predetermined $V_{max}$ and $V_F$ by including a voltage subtraction circuit.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
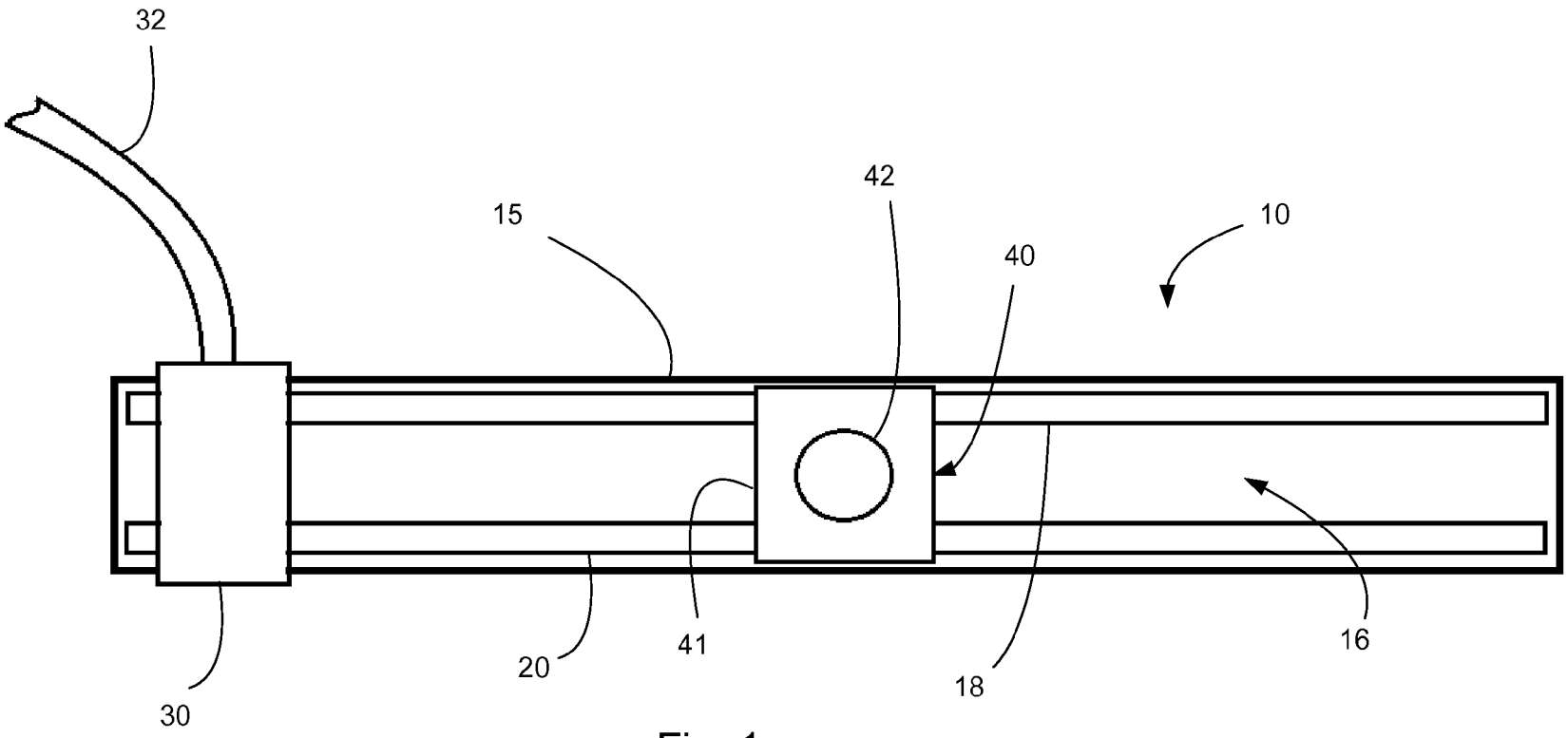
FIG. 1 illustrates a schematic representation of an embodiment of a two conductor track light fixture.

FIG. 1 illustrates a schematic representation of an embodiment of a light system 10. A fixture 15 includes a first contact 18 and a second contact 20 with a thermal interface 16 positioned between the first and second contacts 18, 20. As can be appreciated, the first and second contact are depicted as having a rail shape and are electrically isolated from each other and the fixture 15. The fixture 15 can be configured to operate as a heat sink if desired. A voltage module 30, which is connected to power source via conductor 32, is positioned so as to be electrically connected to the first and second contacts (thus providing a first voltage—$V_1$). In one embodiment the voltage module simply provides an electrical connection and any voltage conversion is done outside the system. In another embodiment, the voltage module can be configured to convert an input voltage to the desired $V_1$. For example, the input voltage could be line voltage (e.g., 120 VAC or 220 VAC) and $V_1$ could be 24 volts. The voltage module can also include the ability to output a range of voltages for $V_1$ (e.g., it may be adjustable).

It should be noted that while the contacts 18, 20 are shaped in an elongated manner so as to prove a shape compatible with a rail configuration, in alternative embodiments the two contacts could be some other shape. Thus, the shape of the contacts is not intended to be limiting unless otherwise noted. It has been determined, however, that many of the benefits of the system disclosed herein is helpful in rail shaped systems; in part because providing a convention three-wire control system is somewhat awkward and less desirable.

An LED module 40 is mounted on the fixture 15 and includes a housing 41 with an LED emission area 42. The LED emission area includes a plurality of LEDs that are arranged in series. In certain embodiments there will be a number of LED series arranged in parallel. In other embodiments there will be a single string of LEDs. As can be appreciated, the LEDs can be simple chips mounted in desired manner (e.g., using a chip-on-board or COB package) or emitters that each include one or more LED chips. And, as is known, a phosphorous-based (or nano-dot based) disk can be provided to convert light emitted from the LED chips into a more desirable wavelength of light. For ease of discussion, however, the LED emission area will be considered string of one or more LEDs and the other features will not be further discussed.

Figure 2:
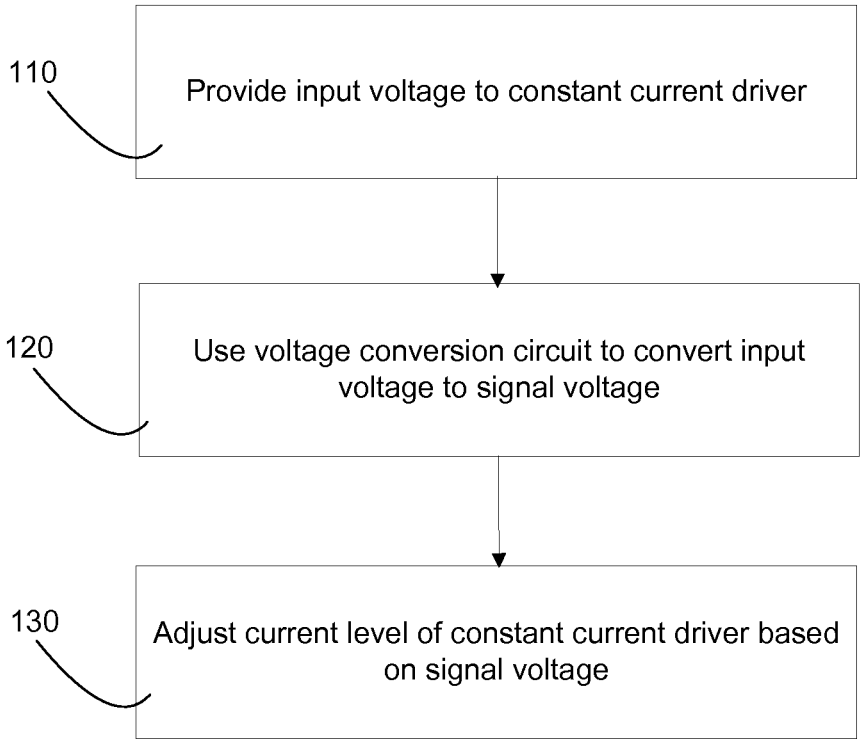
FIG. 2 illustrates steps in a method of controlling a dimmable LED module using a two conductor system

FIG. 2 illustrates a method of using the voltage received from the voltage module to adjust the current provided by a constant current driver. As can be appreciated, one benefit of the system is that the input voltage can be adjusted in a wide range of ways without impacting the performance of the module. Thus, in step 110 an input voltage is provided to the constant current driver. In step 120 the input voltage is converted to a signal voltage. In step three the signal voltage is used to vary the output current from the constant current driver. As can be appreciated, this method allows the input voltage to be varied and to reduce the amount of current being provided to the LED string based on the variance in input voltage without having to worry that the input voltage is going to be reduced below a level that would cause the LED string to cease to function. This is particularly beneficial if there are multiple LED modules connected in parallel to the input voltage.

Figure 3:
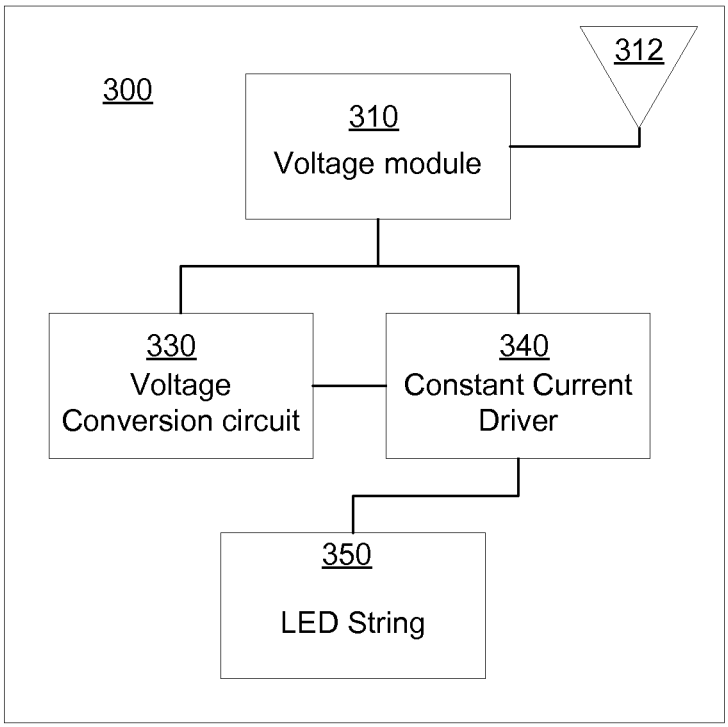
FIG. 3 illustrates a schematic representation of an exemplary LED system that includes a conversion circuit.

FIG. 3 illustrates a system 300 configured to provide adjustable light output while using two wires to provide power to the constant current driver 340 without the need for encoding signals. A voltage module 310 is configured to provide a range of voltages. The voltage module can optionally include an antenna 312 and be configured to receive control signals wirelessly or the control signal can be provided through other desirable means. Regardless, in response to the control signal the voltage is varied. As can be appreciated, the voltage can be varied through a number of known techniques, such as, without limitation, the use of switching regulators, linear regulators or some combination of both. The constant current driver 340 is configured to provide constant current to an LED string 350 but the amount of constant current can is adjusted by an input signal (e.g. which can be a voltage level) received from a conversion circuit 330. For a constant current driver that is configured to work with an input signal of between 1-10 volts, for example, it is necessary to provide a input signal of less than 10 volts if the output of the constant current driver is to be reduced (e.g., the LED string is to be dimmed). By reducing the voltage provided by the voltage module 310, the voltage of the input signal can be reduced and the constant current driver 340 correspondingly can reduce the current being supplied to the LED string 350. Thus, the conversion circuit 330 converts a voltage level provided by the voltage module (which may be controlled separately and is kept above a $V_F$ level) to a signal input. It should be noted that any desirable type of circuitry can be used.

Figure 4:
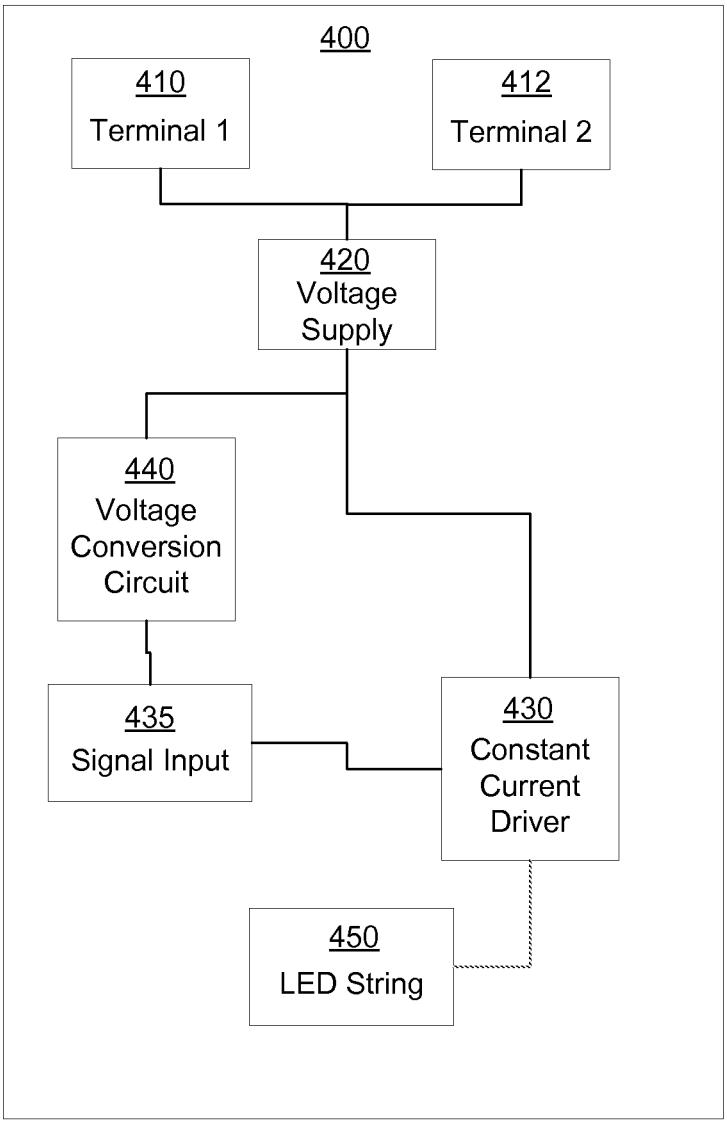
FIG. 4 illustrates a schematic representation of a LED module suitable for use in a system.

A LED module 400, which is preferably removably mounted to the fixture, is schematically represented in FIG. 4 and includes a first terminal 410 and a second terminal 412 that are electrically connected, respectively, to the first and second contacts when the LED module is mounted to the fixture. The LED module 400 can include an optional voltage supply circuit 420 that includes a rectifier and other regulators if the voltage provided by the voltage module is in AC form and the voltage supply circuit provides the input power with a voltage $V_1$ to the constant current driver 430. The constant current driver 430 provides a constant current output to an LED string 450 and can vary that constant current in response to a change in a signal provided to a input signal 435. A conversion circuit 440 receives the voltage $V_1$ and converts it to a signal voltage having a voltage level compatible with the range of values expected to be received in the input signal 435 by the constant current driver 430. In an embodiment the level of the signal could vary between 0.2 V and 1.2 V (thus a 0.1 V difference in the voltage level of the signal would be equal to a 10 percent difference in current output).

In order to provide a variable signal to the constant current driver, $V_1$ is converted by the conversion circuit 440. If the voltage supply circuit 420 has limited functionality (or is omitted) then $V_1$ can be adjusted remotely. If the voltage supply circuit 420 is capable be outputting different values for $V_1$ then the voltage supply circuit 420 can be controlled directly. In an embodiment the direct control can be accomplished by providing a wireless signal that controls $V_1$. Alternatively the voltage supply circuit 420 can include a manual switch or receive a control signal in a convention manner (e.g., be responsive to convention dimming controls).

Regardless of how it is provided, the voltage input $V_1$ can varied over a range of voltages that all exceed the forward voltage $V_F$ of the LED string powered by the LED module 400 (e.g., $V_1$ is varied within a normal operating range of the constant current driver 430). With a convention system, the change in voltage $V_1$ would not impact the output of the constant current driver 430 as it would continue to output a constant current. Or, to put in another way, the change in voltage $V_1$ would not cause the current being applied to the LED string 450 to change.

In order to use changes in $V_1$ to provide dimming capabilities, a conversion circuit takes $V_1$ and converts it to a range that corresponds to a desired input signal $V_s$ for the corresponding constant current driver. For example, if $V_1$ ranges between 24 and 12 volts, a resistive voltage divider based on the formula $V_s=(Z_2/(Z_1+Z_2)*V_1$ can be used to provide a signal that ranges from 1.0 to 0.5 volts by setting $Z_2$=1 kΩ and $Z_1$=23 kΩ. Naturally, the voltage divider can be adjusted so as to provide different conversion ratios/percentages if desired.

To provide for something closer to a 1.0-0.0 volt range signal, an op amp or any other suitable circuitry/component can be used to subtract some number of volts before using a voltage divider. In an example where the V1 varies from 24V to 12 V, 10 volts could be first subtracted and then the 14V to 2V range could be converted with a divider circuit having a setting of $Z_2$=1 kΩ and $Z_1$=10 kΩ. Naturally, the type of circuitry used can vary and there are a number of alternative circuits. Thus, the conversion circuit can be any desirable circuitry that takes an input voltage range and converts it to a predefined signal input range, where the input voltage range is greater than $V_F$. One significant advantage of using a resistive voltage divider, however, is that resistive voltage dividers are relatively immune to changes in temperature because the coefficients tend to cancel out. It should be noted that in general, the values of resistance can expect to cause the voltage to be reduced by at least 4 times and in the above example, slightly more than 10 times.

Figure 5:
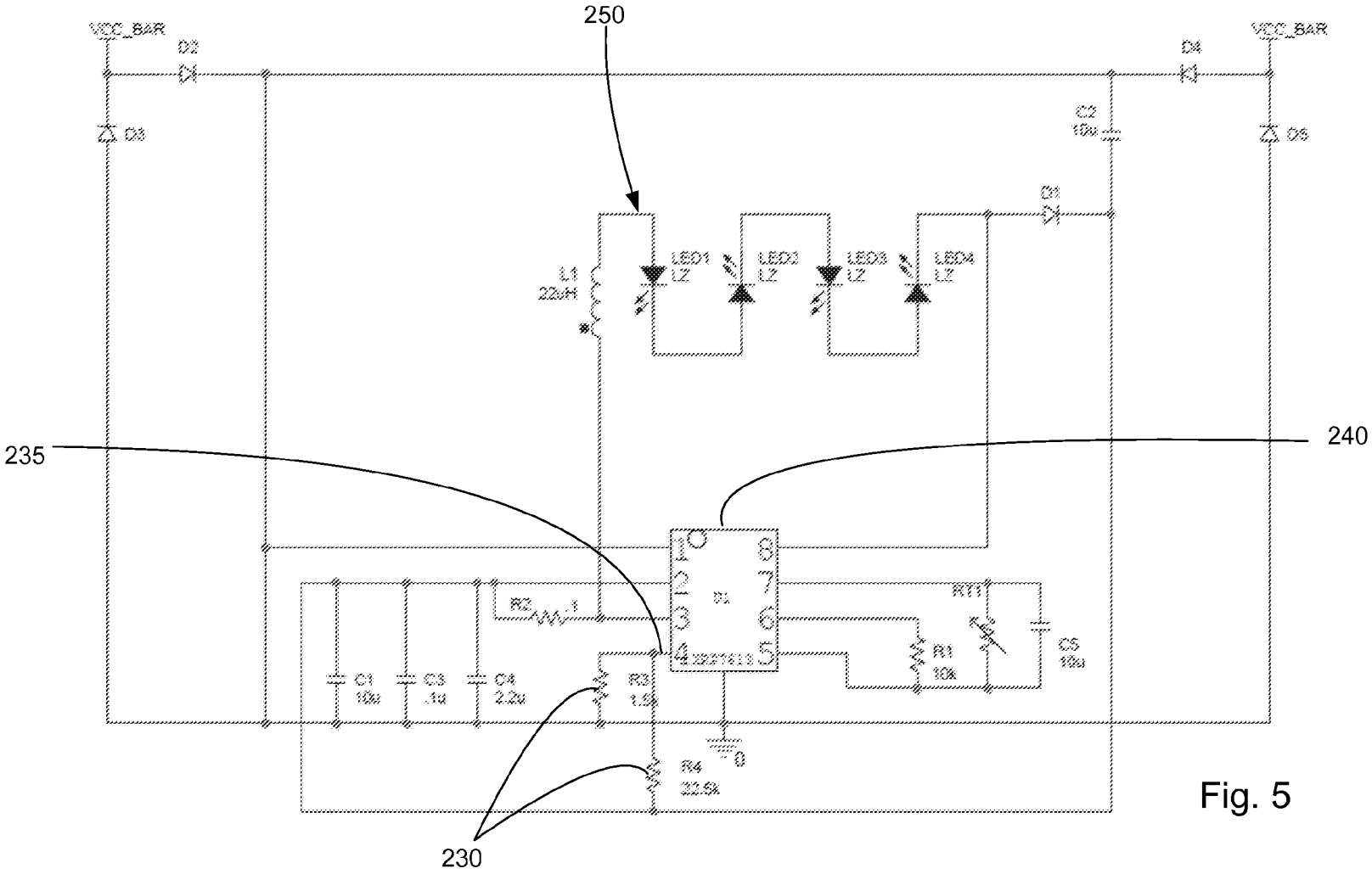
FIG. 5 illustrates a schematic of an exemplary embodiment of a control circuit suitable to control a dimmable LED using a two conductor system.

FIG. 5 illustrates a schematic of an exemplary circuit that includes a constant current driver 240 with an input signal 235 that receives a signal voltage from conversion circuitry 230. The constant current driver 240 powers an LED string 250. As can be appreciated, the LED string 250 is a plurality of LEDs connected in series and feedback is provided to the constant current driver 240 so that it can operate as intended. As can be appreciated, the conversion circuit is depicted as a simple voltage divider that provides a ratio of 1.5 kΩ/(1.5 kΩ+22.5 kΩ) or the input signal is set so that the voltage equal about $0.0625(V_1)$. Naturally, a more complex conversion circuit (as discussed above) could be provided if desired.

Figure 6:
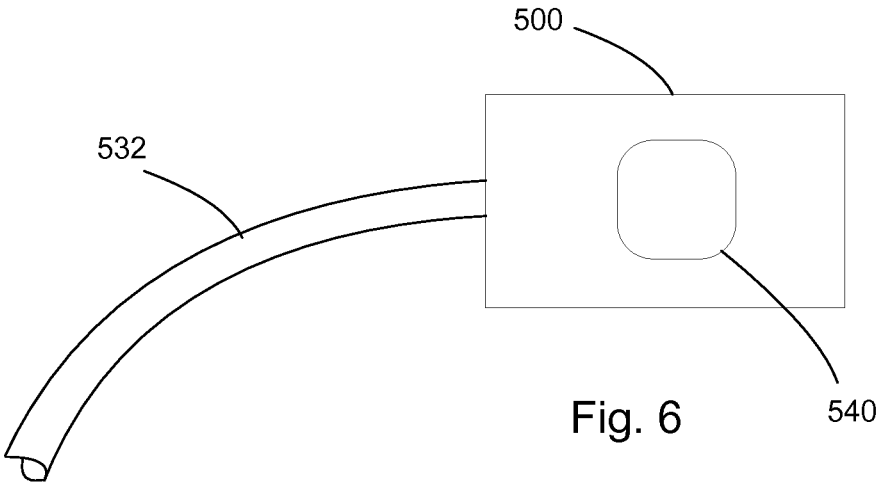
FIG. 6 illustrates a schematic representation of a fixture assembly.
Figure 7:
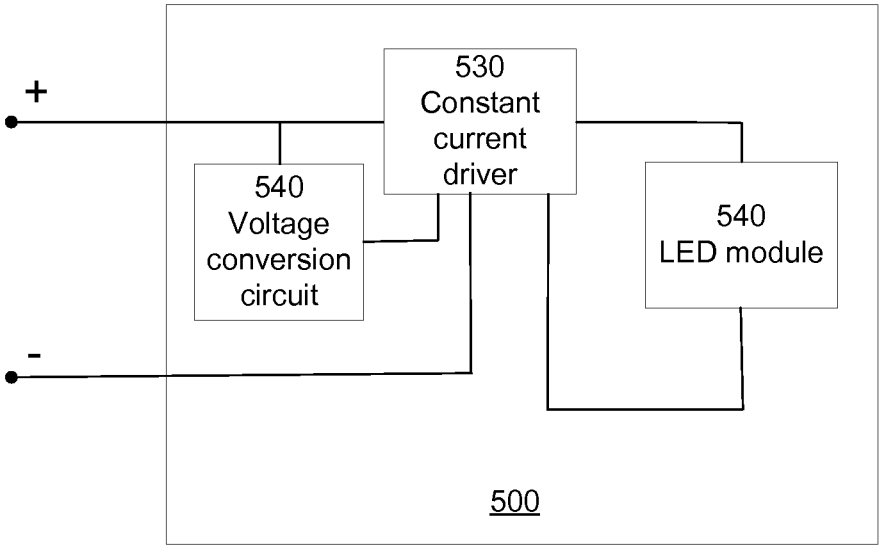
FIG. 7 illustrates a schematic representation of a control system that can be provided in the fixture assembly depicted in FIG. 6.

FIGS. 6 and 7 illustrate another embodiment of a simplified LED fixture 500 that can utilize two wires to provide dimming control. Wire 532 provides a voltage input $V_1$ to the LED fixture 500 and the LED fixture 500 includes an LED module 540 that is powered and supported by the LED fixture 500. The LED fixture 500 includes a constant current driver 530 that can be selectively configured to provide a constant current output so long as $V_1$ exceeds a predetermined minimum voltage (which is based, at least in part, on the forward voltage of the LED module 540). The constant current driver 530 is configured to selectively vary the current based on an input signal. Typically a third conductor could be used to provide the input signal, however the depicted embodiment doesn't require a third conductor. Instead $V_1$ is varied between $V_{max}$ and $V_{min}$, where $V_{min}$ is above the predetermined minimum voltage necessary for the constant current driver 530 to function. A conversion circuit 540 converts the $V_1$ to a desired input signal. For example, if the constant current driver 530 is configured to receive an input signal that varies between 1-10 volts then the conversion circuit can be configured to use the ratio between the $V_{max}$ and $V_{min}$ and $V_1$ to proportionally generate a corresponding input signal that ranges between 1 and 10 volts.

As an example, but without limitation, if $V_{max}$ is 24 volts and $V_{min}$ is 15 volts, then the conversion circuit 540 could simply subtract 14 volts from the $V_1$ and provide that as the input signal to the constant current driver 530. Thus, if the $V_1$ was 15 volts then the input signal would be 1 volt and the current level would be set at 1/10 of the maximum current. Naturally, the conversion circuit 540 could also provide more complex conversions based on what $V_{max}$ and $V_{min}$ for the system and the desired input signal levels are for the constant current driver. While some drivers can provide 10 levels of current based on the corresponding signal input, some greater or lesser number of levels of current could also be provided. For example, the constant current driver could be configured to provide four levels of output based on four levels of input signal (and the levels of the input signal could be a range of voltages). Thus, considerable flexibility is possible.

It should be noted that while the embodiment depicted in FIG. 7 is suited for a DC input, $V_1$ can be a DC voltage or AC voltage. If $V_1$ is a DC voltage then it is possible that no additional conversion and conditioning functionality is needed and the circuitry could be as depicted and a voltage module such as the previously discussed voltage module 310 could be omitted. If the $V_1$ is an AC voltage then a rectifier and regulator/smoothing circuitry can be used to convert the $V_1$ to a DC voltage prior to the conversion circuit and the constant current driver. Naturally, both the conversion circuit and the constant current driver could also each include their own AC to DC conversion circuitry but it is expected that having a voltage supply that is shared will result in a more cost effective and potentially more efficient system.

It should be noted that the conversion circuitry could be integrated directly into the constant current driver. One disadvantage of such integration is that it might require a custom constant current driver for each application and the cost to make a new driver is not insubstantial. However, it is contemplated that for higher volume applications it may make sense for the conversion circuit to be integrated and such integration is within the scope of the disclosure so long as the conversion circuit converts a range of voltages above VF to a corresponding signal level. Thus, for example and without limitation, the constant current driver 530 and conversion circuit 540, which are depicted separately, could also be provided as single element that is a constant current driver with an integrated conversion circuit.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. An LED module, comprising:

a housing;

an LED string supported by the housing;

a first terminal and a second terminal supported by the housing;

a constant current driver coupled to the first and second terminal, the constant current driver configured to provide a constant output current to power the LED string for a range of voltages above a minimum voltage $V_F$, the constant current driver further configured to vary the output current based on an input signal; and a conversion circuit positioned in the housing and configured to receive a voltage from the first and second terminals and to convert the voltage to a signal level that ranges between a first level and a level that is less than the first level, the conversion circuit configured to provide the signal level as the input signal.

2. The LED module of claim 1, wherein the conversion circuit includes a resistive voltage divider.

3. The LED module of claim 2, wherein the conversion circuit includes a voltage subtraction circuit.

4. The LED module of claim 1, wherein the LED string comprises at least one LED.

5. An LED system, comprising:

a fixture including a first contact and a second contact, the first and second contacts electrically separated from the fixture and each other;

a voltage module supported by the fixture, the voltage module configured to provide a first voltage to the first and second contacts; and an LED module removably mounted to the fixture, the module including a constant current driver and an LED string and a conversion circuit configured to convert the first voltage to a signal voltage that is less than the first voltage, wherein the constant current driver is configured to adjust a current output in response to the signal voltage.

6. The LED system of claim 5, wherein the voltage module is configured to provide a variable first voltage.

7. The LED system of claim 5, wherein the conversion circuit is configured to provide a signal voltage that is between 0 volts and 1.5 volts.

8. The LED system of claim 5, wherein the conversion circuit is configured to provide a signal voltage that is at least 10 times less than the first voltage.

9. The LED system of claim 5, wherein the fixture and the first and second contacts are elongated so as to provide a track-like shape.

10. The LED system of claim 5, wherein the LED string comprises at least one LED.

11. The LED system of claim 6, wherein the voltage module is configured to receive a control input wirelessly and to vary the first voltage in response to the control input.

* * * * *